US009523136B2

(12) United States Patent
Tseng

(10) Patent No.: US 9,523,136 B2
(45) **Date of Patent: *Dec. 20, 2016**

(54) CONTINUOUS FURNACE SYSTEM

(71) Applicant: King Yuan Dar Metal Enterprise Co., Ltd., Changhua (TW)

(72) Inventor: Chang Lung Tseng, Changhua (TW)

(73) Assignee: King Yuan Dar Metal Enterprise Co., Ltd., Hsiensi, Changhua (TW)

( * ) Notice: Subject to any disclaimer, the term of this patent is extended or adjusted under 35 U.S.C. 154(b) by 215 days.

This patent is subject to a terminal disclaimer.

(21) Appl. No.: 14/225,504

(22) Filed: Mar. 26, 2014

(65) Prior Publication Data

US 2015/0275325 A1 Oct. 1, 2015

(51) Int. Cl.

| | |
|---|---|
| ***C21D 9/00*** | (2006.01) |
| ***C23C 8/80*** | (2006.01) |
| ***C23C 8/02*** | (2006.01) |
| ***C23C 8/22*** | (2006.01) |
| ***F27B 1/00*** | (2006.01) |
| ***F27B 9/04*** | (2006.01) |
| ***F27B 9/10*** | (2006.01) |
| ***F27B 9/20*** | (2006.01) |
| ***F27B 9/40*** | (2006.01) |
| ***F27D 7/04*** | (2006.01) |
| ***F27D 19/00*** | (2006.01) |
| ***F27D 21/00*** | (2006.01) |
| *F27B 9/12* | (2006.01) |

(52) U.S. Cl.

CPC ..... *C21D 9/0056* (2013.01); *C21D 9/0018* (2013.01); *C21D 9/0062* (2013.01); *C23C 8/02* (2013.01); *C23C 8/22* (2013.01); *C23C 8/80* (2013.01); *F27B 1/00* (2013.01); *F27B 9/045* (2013.01); *F27B 9/047* (2013.01); *F27B 9/10* (2013.01); *F27B 9/20* (2013.01); *F27B 9/40* (2013.01); *F27D 7/04* (2013.01); *F27D 19/00* (2013.01); *F27D 21/00* (2013.01); *F27B 2009/122* (2013.01); *F27B 2009/124* (2013.01)

(58) Field of Classification Search

CPC ... C21D 9/0056; C21D 9/0062; C21D 9/0018; C23C 8/02; C23C 8/80; C23C 8/22; F27B 1/00

USPC ..... 266/102, 103, 249, 251, 252; 432/120, 432/121, 128, 201, 198, 209, 59, 176, 152

See application file for complete search history.

(56) References Cited

U.S. PATENT DOCUMENTS 2,091,172 A * 8/1937 Wilson ..... C21D 9/0062 219/50
4,227,874 A 10/1980 Nugent
4,582,301 A 4/1986 Wunning
(Continued)

*Primary Examiner* — Scott Kastler
*Assistant Examiner* — Michael Aboagye
(74) *Attorney, Agent, or Firm* — Charles E. Baxley

(57) ABSTRACT

A furnace system includes a pre-heating device disposed on a conveyer device, a heating member disposed in the pre-heating device for pre-heating the work piece, a furnace facility located behind the pre-heating device and having a heating zone, a carburizing zone for carburizing the work piece, a diffusing zone and a temperature decreasing zone for lowering the temperature of the work piece, and a cooling zone for lowering the work piece to a room temperature, the furnace facility includes a front door and a rear door and one or more intermediate doors for confining the work piece within the furnace facility, and a heating element is disposed in the furnace facility for pre-heating the work piece.

5 Claims, 5 Drawing Sheets

(56) References Cited

U.S. PATENT DOCUMENTS

| | | | | | |
|---|---|---|---|---|---|
| 4,627,814 | A * | 12/1986 | Hattori | C21D 1/74 | 432/128 |
| 4,767,320 | A * | 8/1988 | Sasaki | F27B 9/40 | 432/152 |
| 5,273,585 | A * | 12/1993 | Shoga | C21D 1/74 | 118/719 |
| 5,749,978 | A * | 5/1998 | Colombani | B01F 3/022 | 148/216 |
| 5,848,890 | A | 12/1998 | McCormick | | |
| 7,018,584 | B2 * | 3/2006 | Serafini, Jr. | B22F 3/1028 | 266/252 |
| 7,029,625 | B2 * | 4/2006 | Shimosato | C21D 1/773 | 266/250 |
| 7,520,746 | B1 | 4/2009 | Johnston et al. | | |
| 8,298,475 | B2 * | 10/2012 | Tseng | C21D 9/0056 | 266/156 |

* cited by examiner

CONTINUOUS FURNACE SYSTEM

BACKGROUND OF THE INVENTION

1. Field of the Invention

The present invention relates to a furnace system, and more particularly to a high temperature and continuous furnace system including a pre-heating device for pre-heating the work piece to the required temperature, a furnace facility including a heating zone and a carburizing zone for heating the work piece to a higher temperature, and a diffusing zone and a cooling zone for suitably cooling the work piece to the required structure or strength.

2. Description of the Prior Art

Typical steel materials, such as the high chromium steel materials or plates comprise a number of slits or slots or gaps formed or provided therein while subjected with various heating processes or procedures with various kinds of furnace facilities, such that the strengths of the typical high chromium steel materials are low or are not good enough to make products and may become defective products.

For solving such problems, the skilled technicians use or employ a high temperature to heat the typical high chromium steel materials and to have the slits or slots or gaps formed or provided in the typical high chromium steel materials filled with the steel materials and to have a compact and solid structure such that the strengths of the typical high chromium steel materials may be suitably increased and may be used and made into various kinds of products.

For the typical high chromium steel material heating furnaces, the high chromium steel materials or plates are required to be disposed or engaged into the typical steel furnaces for heating the high chromium steel materials or plates to the required higher temperature and for allowing the slits or slots or gaps formed or provided in the typical high chromium steel materials or plates to be filled with the steel materials and to have a compact and solid structure.

However, after the heating operations, the heated high chromium steel materials or plates should be removed from the typical steel furnaces for cooling purposes, and a number of skilled technicians and man working hours are required to move the typical high chromium steel materials or plates into and out of the typical steel furnaces such that manufacturing procedures and cost will be greatly increased.

U.S. Pat. No. 4,227,874 to Nugent, U.S. Pat. No. 4,582,301 to Wunning, U.S. Pat. No. 4,767,320 to Sasaki et al., U.S. Pat. No. 5,848,890 to McCormick, and U.S. Pat. No. 7,520,746 to Johnston et al. disclose several of the typical furnace product supporting or transporting devices for supporting or transporting the typical high chromium steel materials or plates into and out of the typical steel furnaces.

However, the typical furnace product supporting or transporting devices may only be used to support or to transport the typical high chromium steel materials or plates into and out of the typical steel furnaces, but may not be used to move or to transport the typical high chromium steel materials or plates between heating zones and/or cooling zones.

In addition, without pre-heating processes or procedures, the typical high chromium steel materials or plates will be quickly heated to a very high temperature and may have a good chance to be distorted or twisted and will become a defect product. Furthermore, the heat energy generated during the heating processes or procedures may not be recycled or reused such that a number of heat energy will be wasted.

For improving or overcoming the afore-described disadvantages of the conventional steel furnace systems, the applicant had developed another typical high temperature and continuous furnace system and issued as U.S. Pat. No. 8,298,475 to Tseng which includes a heating zone and one or more cooling zones for suitably heating the high chromium steel and for allowing the high chromium steel to have a compact and solid structure, and includes a heat energy recycling or reusing system to recycle or reuse the heat energy and to economize the heat energy, and includes a pre-heating zone for pre-heating the high chromium steel before the high chromium steel is heated to a required or predetermined high temperature and for preventing the high chromium steel from being distorted or twisted.

However, the metal products made or manufactured with the typical high temperature and continuous furnace system may also have a cracking problem; i.e., a number of slits or slots may still be formed within the metal products such that the defective products may have a good chance to be formed.

The present invention has arisen to mitigate and/or obviate the afore-described disadvantages of the conventional steel furnace systems.

SUMMARY OF THE INVENTION

The primary objective of the present invention is to provide a high temperature and continuous furnace system including a pre-heating device for pre-heating the work piece to the required temperature, a furnace facility including a heating zone and a carburizing zone for heating the work piece to a higher temperature, and a diffusing zone and a cooling zone for suitably cooling the work piece to the required structure or strength.

In accordance with one aspect of the invention, there is provided a furnace system comprising a conveyer device for supporting and transporting a work piece, a pre-heating device supported on the conveyer device and located at an entrance portion of the conveyer device for receiving the work piece and for pre-heating the work piece, the pre-heating device including a front door and a rear door for confining the work piece within the pre-heating device, a heating member disposed in the pre-heating device for pre-heating the work piece, a furnace facility disposed on the conveyer device and located behind the pre-heating device, the furnace facility including a longitudinal chamber formed therein for receiving the work piece, and including a heating zone for further heating the work piece to a higher temperature, a carburizing zone located behind the heating zone for further heating the work piece and for carburizing the work piece, a diffusing zone located behind the carburizing zone for lowering the temperature of the work piece, a temperature decreasing zone located behind the diffusing zone for decreasing the temperature of the work piece, and a cooling zone located behind the temperature decreasing zone for lowering the work piece to a room temperature, the furnace facility including a front door and a rear door and at least one intermediate door for confining the work piece within the furnace facility, the conveyer device being provided for transporting and moving the work piece from the pre-heating device through the heating zone and the carburizing zone and the diffusing zone and the temperature decreasing zone and the cooling zone of the furnace facility, and a heating element disposed in the furnace facility for pre-heating the work piece.

The pre-heating device includes a safety valve and a discharging port provided in the pre-heating device for preventing the pre-heating device from being over-pressurized. The pre-heating device includes a fan device for air circulating purposes. The pre-heating device includes a thermometer for detecting a temperature in the pre-heating device.

The furnace facility includes a safety valve and a discharging port provided in the furnace facility for preventing the furnace facility from being over-pressurized. The furnace facility includes a fan device for air circulating purposes.

The furnace facility includes an oxygen detector for detecting an oxygen quantity in the furnace facility. The furnace facility includes a nitrogen supplying port for supplying a nitrogen to the furnace facility.

The furnace facility includes a methyl alcohol supplying mouth disposed in the heating zone, the carburizing zone or the diffusing zone for supplying a methyl alcohol to the heating zone, the carburizing zone or the diffusing zone of the furnace facility.

A receptacle may further be provided and disposed below a rear end portion of the conveyer device for collecting the work piece.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
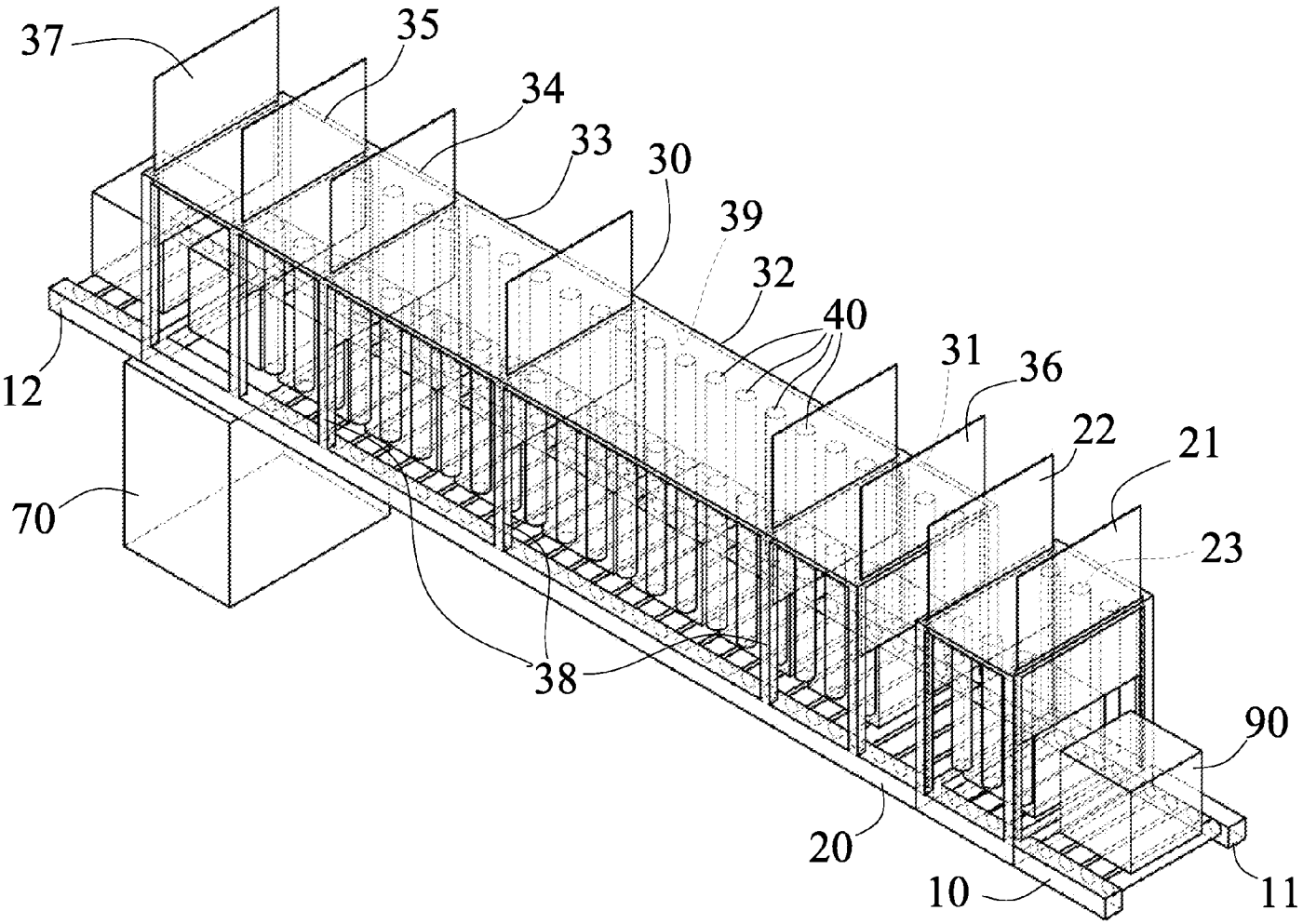
FIG. 1 is a perspective view of a furnace system in accordance with the present invention.
Figure 2:
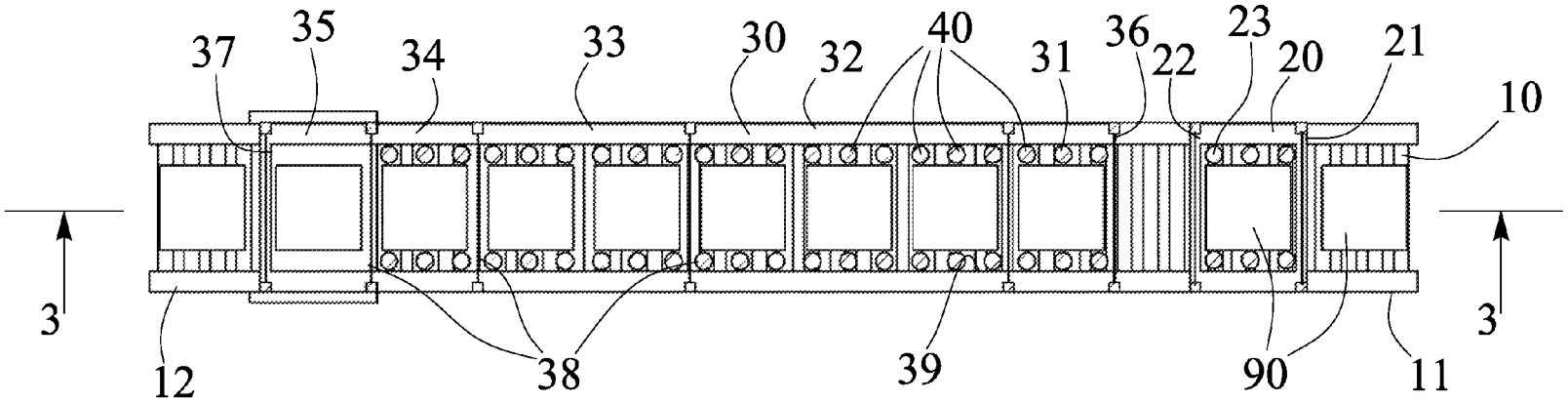
FIG. 2 is a top plan schematic view of the furnace system.
Figure 3:
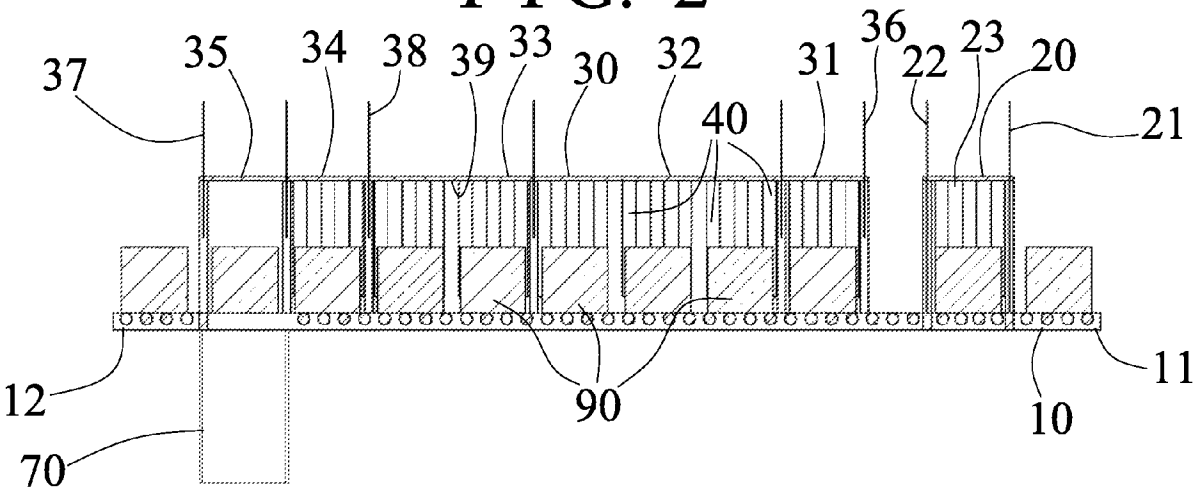
FIG. 3 is a cross sectional view of the furnace system taken along lines 3-3 of FIG. 2.
Figure 4:
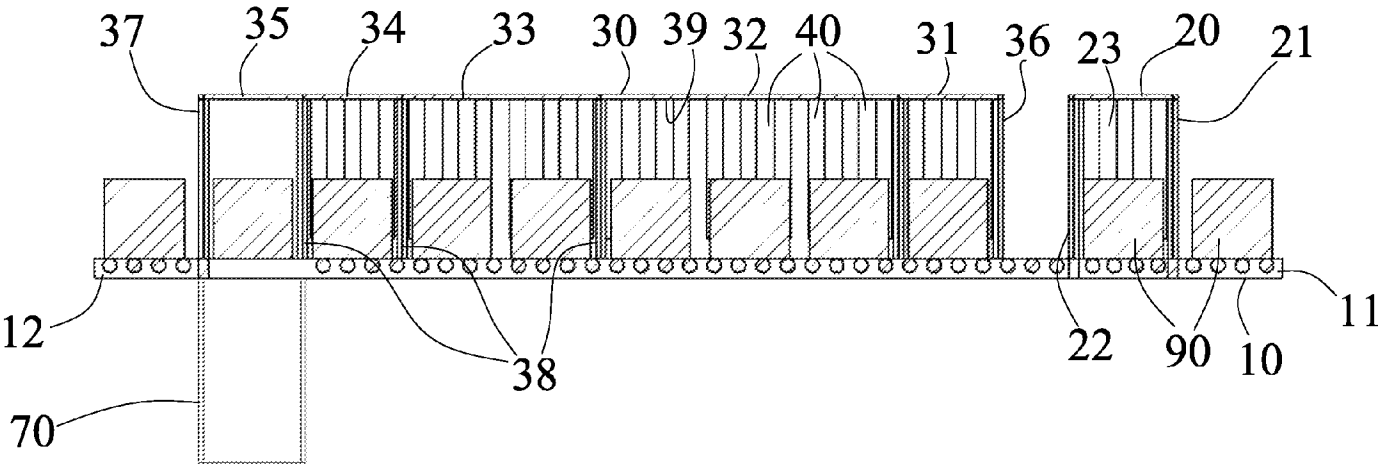
FIGS. 4, 5 are cross sectional views similar to FIG. 3, illustrating the operation of the furnace system.
Figure 5:
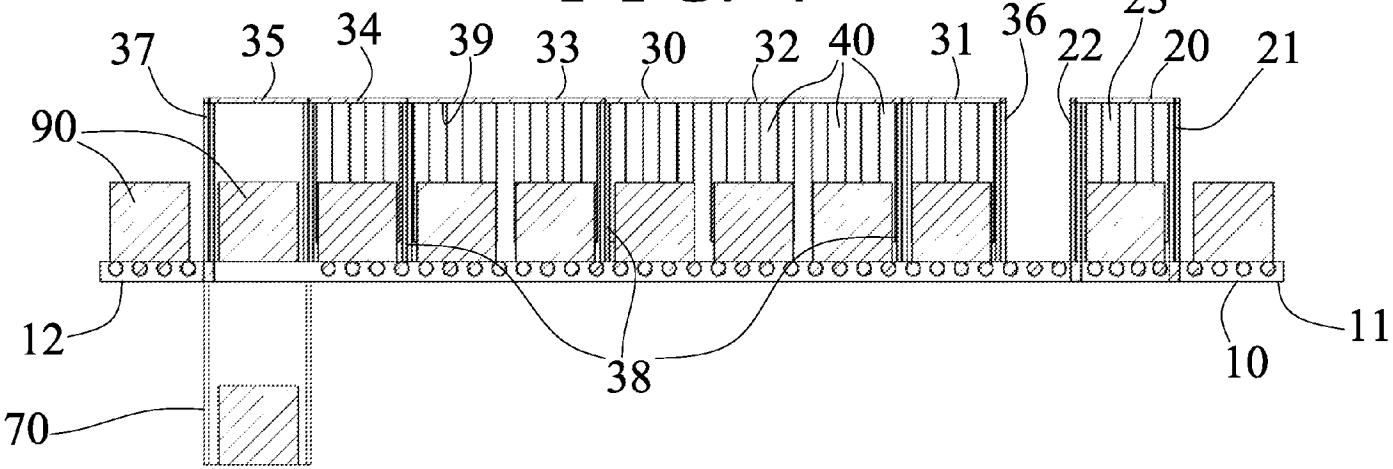

Referring to the drawings, and initially to FIGS. 1-3, a furnace system in accordance with the present invention comprises a belt or band or roller conveyer device 10 for supporting or transporting the high chromium steel materials or plates or work pieces 90 along the conveyer device 10, a heater, such as an independent pre-heating device 20 disposed or attached or mounted or supported on top of the conveyer device 10 and arranged or located at the entrance or front portion 11 of the conveyer device 10 for receiving the work piece 90 and for gradually pre-heating the work piece 90 to the required or predetermined temperature (about 0~500° C.), the pre-heating device 20 includes a front door 21 and a rear door 22 for selectively enclosing the pre-heating device 20 and for suitably confining or retaining or positioning the work piece 90 within the pre-heating device 20, and a heating member 23 is disposed or attached or mounted or engaged in the pre-heating device 20 for gradually pre-heating the work piece 90 to the required or predetermined temperature (about 0~500° C.).

A furnace facility 30 is also disposed or attached or mounted or supported on top of the conveyer device 10 and disposed or arranged or located behind the pre-heating device 20, and includes a heating zone 31 disposed or located or arranged behind the pre-heating device 20 and disengaged or separated from the pre-heating device 20 for further heating and increasing the temperature of the work piece 90 to the required or predetermined higher temperature (about 500~750° C.), and a carburizing zone 32 disposed or located or arranged behind the heating zone 31 for further heating and increasing the temperature of the work piece 90 to the required or predetermined higher temperature (about 750~930° C.), and for carburizing the work piece 90, and an annealing or diffusing zone 33 disposed or located or arranged behind the carburizing zone 32 for slightly lowering or decreasing the temperature of the work piece 90 to the required or predetermined less or lower temperature (about 930~860° C.) and for diffusing the work piece 90.

The furnace facility 30 further includes an ageing or temperature decreasing zone 34 disposed or located or arranged behind the diffusing zone 33 for further gradually lowering or decreasing the temperature of the work piece 90 to the required or predetermined less or lower temperature (about 860~830° C.), and a cooling zone 35 disposed or located or arranged behind the ageing or temperature decreasing zone 34 for further quickly lowering or decreasing the temperature of the work piece 90 to the required or predetermined less or lower or room temperature (about 20° C.). The furnace facility 30 includes a front door 36 and a rear door 37 and one or more middle or intermediate door 38 (FIGS. 1-7) for selectively enclosing the zones 31-35 of the furnace facility 30 and for suitably confining or retaining or positioning the work piece 90 within the respective zones 31-35 of the furnace facility 30, and includes a longitudinal chamber 39 formed therein for slidably receiving or engaging with the work pieces 90.

The furnace facility 30 also includes one or more heating devices or members or elements 40 disposed or attached or mounted or engaged in the furnace facility 30 and located or arranged in at least the heating zone 31 and the carburizing zone 32 for suitably heating and increasing the temperature of the work pieces 90 to the required or predetermined higher temperature. The heating elements 40 and the heating member 23 may be selected from the gaseous heating devices or materials, electrical heating devices or materials or the like for suitably heating the work pieces 90. The temperature of the work pieces 90 will be lowered or decreased in at least the diffusing zone 33 and the temperature decreasing zone 34 and the cooling zone 35 such that no heating devices or members or elements are required to be provided or disposed or located or arranged in the furnace facility 30. The furnace facility 30 may include a cooling device or material or member or element (not illustrated), such as selected from a gaseous, or water or oil or other fluid cooling device or material or member or element for suitably cooling the work pieces 90.

The conveyer device 10 is provided for transporting or moving the work pieces 90 from the pre-heating device 20 through the heating zone 31 of the furnace facility 30, and then toward and through the carburizing zone 32 and the diffusing zone 33 and the temperature decreasing zone 34 and the cooling zone 35 of the furnace facility 30. The furnace system may further include a container or receptacle 70 disposed or located or arranged below the other end or rear end portion 12 of the conveyer device 10 (FIGS. 1 and 3-5) for receiving or collecting the work piece 90 and for allowing the treated or finished work pieces 90 to be easily fetched by the users or workers; and may further include a controlling device, such as a processor device (not shown) attached or mounted thereto for controlling or operating or actuating the doors 21, 22, 36, 37, 38 of the pre-heating device 20 and/or the furnace facility 30 to suitably enclose or release the pre-heating device 20 and/or the zones 31-35 of the furnace facility 30.

Figure 6:
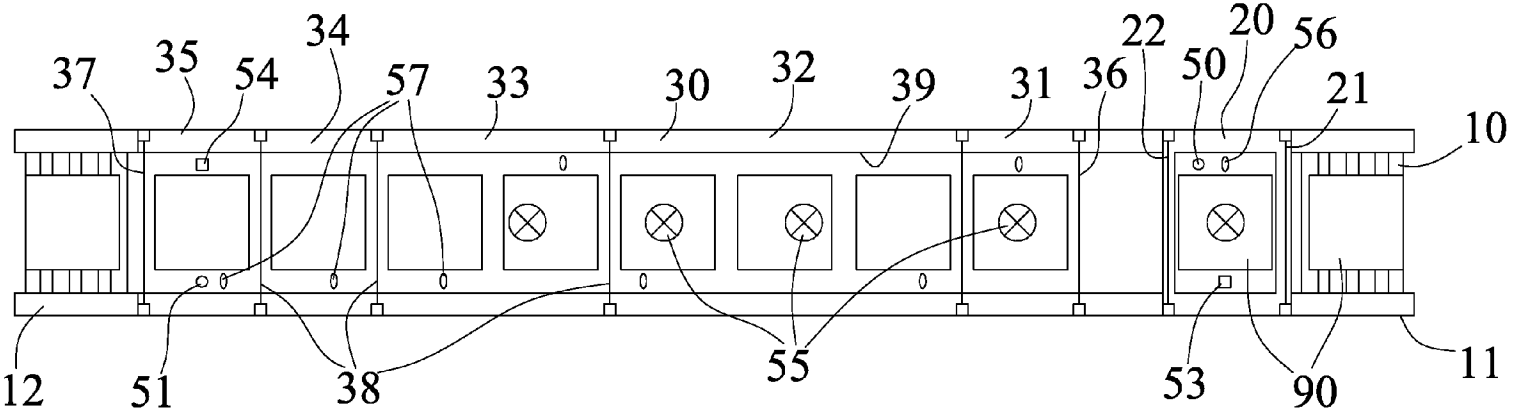
FIGS. 6, 7 are top plan schematic views similar to FIG. 2, illustrating the operation of the furnace system.
Figure 8:
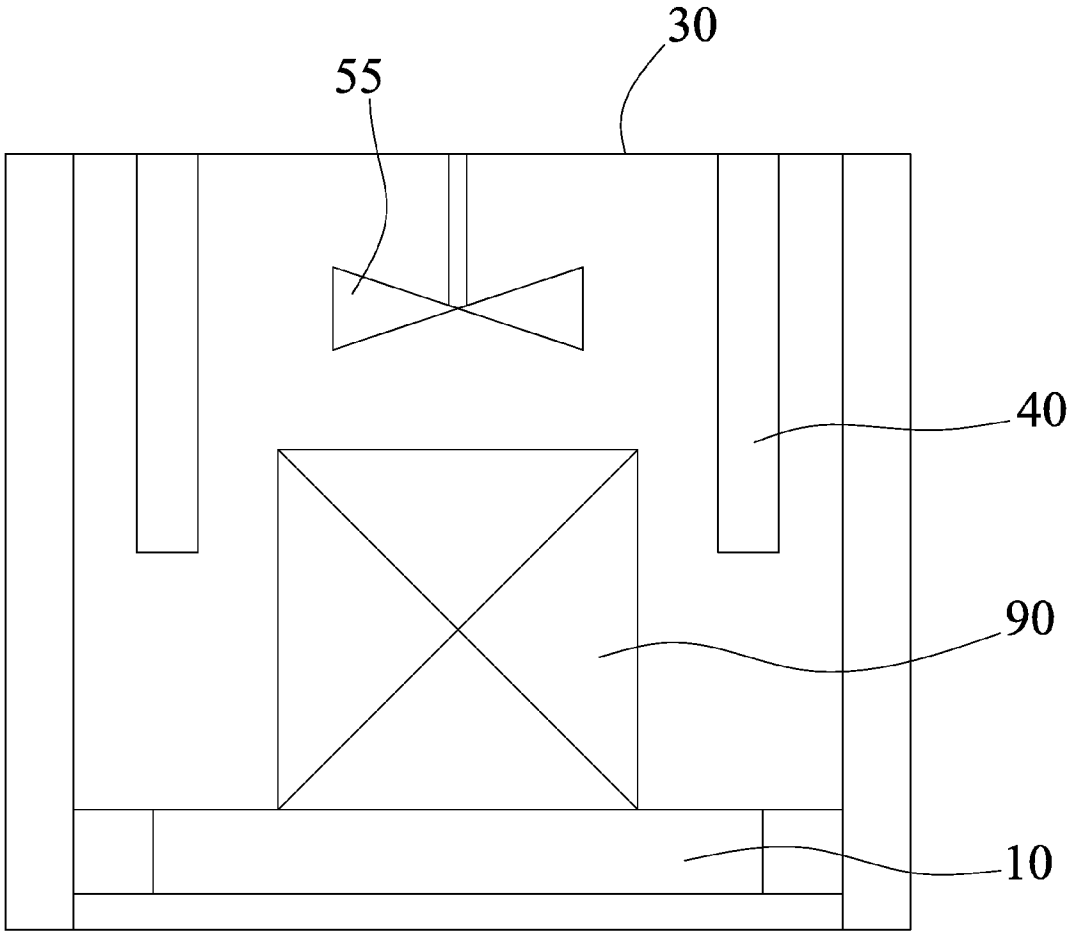
FIG. 8 is a partial end plan schematic view of the furnace system.

As shown in FIG. 6, the furnace system may further include one or more relief or safety valves 50, 51 and/or one or more releasing or discharging ports 53, 54 formed or provided in the pre-heating device 20 and/or the furnace facility 30 for releasing or discharging the gaseous products or the like and for preventing the pre-heating device 20 and/or the furnace facility 30 from being over-pressurized; and may further include one or more fan devices 55 (FIGS. 6, 8) disposed or located or arranged in the pre-heating device 20 and/or the furnace facility 30 for circulating the air and for allowing the temperature to be evenly or uniformly distributed in the pre-heating device 20 and/or the furnace facility 30. The furnace system may further include one or more thermometers 56, 57 (FIG. 6) disposed or located or arranged in the pre-heating device 20 and/or the furnace facility 30 for sensing or detecting the temperature in the pre-heating device 20 and/or in the respective zones 31-35 of the furnace facility 30.

Figure 7:
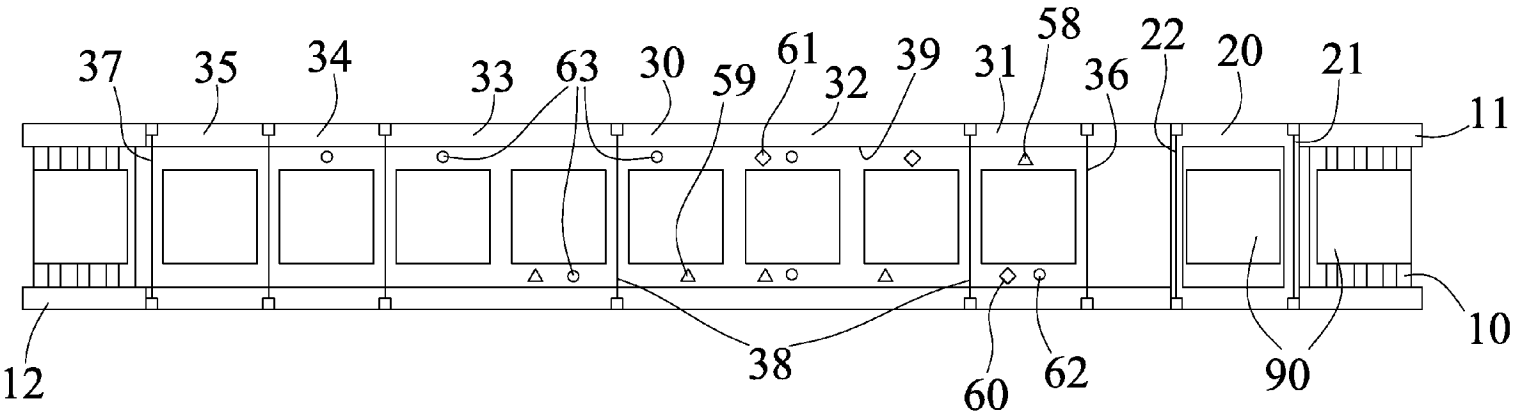

As shown in FIG. 7, the furnace facility 30 may further include one or more oxygen sensors or detectors 58, 59 disposed or located or arranged in at least the heating zone 31 and/or the carburizing zone 32 for sensing or detecting the oxygen quantity contained within the heating zone 31 and/or the carburizing zone 32, and may further include one or more nitrogen supplying ports 60, 61 disposed or located or arranged in at least the heating zone 31 and/or the carburizing zone 32 for supplying the nitrogen to at least the heating zone 31 and/or the carburizing zone 32, and may further include one or more wood alcohol, wood spirit, or methyl alcohol supplying mouths 62, 63 disposed or located or arranged in at least the heating zone 31 and/or the carburizing zone 32 and/or the diffusing zone 33 for supplying the wood alcohol, wood spirit, or methyl alcohol to at least the heating zone 31 and/or the carburizing zone 32 and/or the diffusing zone 33.

In operation, as shown in FIGS. 1-5, the work pieces 90 are gradually transported or moved or sent into and from the pre-heating device 20 through the heating zone 31 and then toward and through the carburizing zone 32 and the diffusing zone 33 and the temperature decreasing zone 34 and the cooling zone 35 of the furnace facility 30. The work piece 90 is gradually pre-heated to the required or predetermined temperature (about 500° C.) in the pre-heating device 20 and preferably stayed or retained in the pre-heating device 20 for about fifteen (15) minutes, and then transported or moved or sent into the heating zone 31 of the furnace facility 30 and further heated to the required or predetermined higher temperature (about 500~750° C.) and preferably stayed or retained in the heating zone 31 for about thirty (30) minutes, and for allowing the slits or slots or gaps formed or provided in the work piece 90 to be filled with the steel materials and to have a compact and solid structure such that the strengths of the work pieces 90 may be suitably increased and may be used and made into various kinds of products and will not become the defect products.

The work piece 90 is then transported or moved or sent into the carburizing zone 32 of the furnace facility 30 and further heated to the required or predetermined higher temperature (about 750~930° C.) and preferably stayed or retained in the carburizing zone 32 for about one hundred and twenty (120) minutes, and for allowing the slits or slots or gaps formed or provided in the work piece 90 to be further filled with the steel materials and to have a further compact and solid structure. The work piece 90 is then transported or moved or sent into the diffusing zone 33 of the furnace facility 30 and slightly or gradually lowered or decreased to the required or predetermined less or lower temperature (about 930~860° C.) and for diffusing the work piece 90. It is preferable that the work piece 90 is stayed or retained in the diffusing zone 33 of the furnace facility 30 for about forty to sixty (40-60) minutes, and for allowing the slits or slots or gaps formed or provided in the work piece 90 to be further completely filled with the steel materials.

The work piece 90 is then transported or moved or sent into the temperature decreasing zone 34 of the furnace facility 30 and slightly or gradually lowered or decreased to the required or predetermined less or lower temperature (about 860~830° C.), and stayed or retained in the temperature decreasing zone 34 of the furnace facility 30 for about thirty (30) minutes and for slightly or gradually lowering or decreasing the temperature of the work piece 90 and for preventing the work piece 90 from being distorted or twisted, and the work piece 90 is then transported or moved or sent into the cooling zone 35 of the furnace facility 30 and lowered or decreased to the less or lower or room temperature, and thus for forming the required work piece 90.

Accordingly, the high temperature and continuous furnace system in accordance with the present invention includes a pre-heating device for pre-heating the work piece to the required temperature, a furnace facility including a heating zone and a carburizing zone for heating the work piece to a higher temperature, and a diffusing zone and a cooling zone for suitably cooling the work piece to the required structure or strength.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A furnace system comprising:

a conveyer device for supporting and transporting a work piece, a heating device supported on said conveyer device and located at an entrance portion of said conveyer device for receiving the work piece and for heating the work piece, said heating device including a front door and a rear door for confining the work piece within said heating device, a heating member disposed in said heating device for heating the work piece, a furnace facility disposed on said conveyer device and located behind said heating device, said furnace facility including a longitudinal chamber formed therein for receiving the work piece, and including a heating zone for further heating the work piece to a higher temperature, a carburizing zone located behind said heating zone for further heating the work piece and for carburizing the work piece, a diffusing zone located behind said carburizing zone for lowering the temperature of the work piece, a temperature decreasing zone located behind said diffusing zone for decreasing the temperature of the work piece, and a cooling zone located behind said temperature decreasing zone for lowering the work piece to a room temperature, said furnace facility including a front door and a rear door and at least one intermediate door for confining the work piece within said furnace facility, said conveyer device being provided for transporting and moving the work piece from said heating device through said heating zone and said carburizing zone and said diffusing zone and said temperature decreasing zone and said cooling zone of said furnace facility, and a heating element disposed in said furnace facility for heating the work piece, and said furnace facility including a safety valve and a discharging port provided in said furnace facility for preventing said furnace facility from being over-pressurized, said furnace facility including a fan device for air circulating purposes, said furnace facility including an oxygen detector for detecting an oxygen quantity in said furnace facility, said furnace facility including a nitrogen supplying port for supplying a nitrogen to said furnace facility, and said furnace facility including a methyl alcohol supplying mouth disposed in said heating zone for supplying a methyl alcohol to said heating zone of said furnace facility, said furnace facility including a methyl alcohol supplying mouth disposed in said carburizing zone for supplying a methyl alcohol to said carburizing zone of said furnace facility, and said furnace facility including a methyl alcohol supplying mouth disposed in said diffusing zone for supplying a methyl alcohol to said diffusing zone of said furnace facility.

2. The furnace system as claimed in claim 1, wherein said heating device includes a safety valve and a discharging port provided in said heating device for preventing said heating device from being over-pressurized.

3. The furnace system as claimed in claim 1, wherein said heating device includes a fan device for air circulating purposes.

4. The furnace system as claimed in claim 1, wherein said heating device includes a thermometer for detecting a temperature in said heating device.

5. The furnace system as claimed in claim 1 further comprising a receptacle disposed below a rear end portion of said conveyer device for collecting the work piece.

* * * * *